US006082340A

United States Patent [19]

Heimark

[11] Patent Number: 6,082,340

[45] Date of Patent: Jul. 4, 2000

[54] TWO-SPEED SUPERCHARGER

[76] Inventor: Charles L. Heimark, 10254 Brittany Way, Eden Prairie, Minn. 55347

[21] Appl. No.: 09/040,576

[22] Filed: Mar. 18, 1998

[51] Int. Cl.[7] ..... F02B 33/00

[52] U.S. Cl. ..... 123/559.1; 123/559.3; 123/561

[58] Field of Search ..... 123/559.1, 559.3, 123/561

[56] References Cited

U.S. PATENT DOCUMENTS

| | | |
|---|---|---|
| 3,463,027 | 8/1969 | Gelb . |
| 3,620,339 | 11/1971 | Becking . |
| 3,675,747 | 7/1972 | Obermark . |
| 3,702,570 | 11/1972 | Stikkers . |
| 3,842,378 | 10/1974 | Pierce . |
| 3,924,585 | 12/1975 | Woods . |
| 4,145,888 | 3/1979 | Roberts . |
| 4,257,508 | 3/1981 | Bennett et al. . |
| 4,314,472 | 2/1982 | Saegusa et al. . |
| 4,445,337 | 5/1984 | McCreary . |
| 4,484,495 | 11/1984 | Mason . |
| 4,486,668 | 12/1984 | Asahi et al. . |
| 4,488,627 | 12/1984 | Streich et al. . |
| 4,564,092 | 1/1986 | Pierce . |
| 4,589,534 | 5/1986 | Apetrei et al. . |
| 4,592,251 | 6/1986 | Mason . |
| 4,718,526 | 1/1988 | Koitabashi . |
| 4,760,756 | 8/1988 | Pabst . |
| 4,769,993 | 9/1988 | Kawamura . |
| 4,862,770 | 9/1989 | Smith . |
| 5,266,836 | 11/1993 | Sousa . |
| 5,289,813 | 3/1994 | Adachi et al. . |
| 5,400,597 | 3/1995 | Mirabile . |
| 5,523,626 | 6/1996 | Hayashi . |
| 5,545,103 | 8/1996 | Gustin . |
| 5,557,977 | 9/1996 | Stockton . |
| 5,575,371 | 11/1996 | Gonda et al. . |
| 5,586,540 | 12/1996 | Marzec . |
| 5,665,018 | 9/1997 | Miyata . |
| 5,672,226 | 9/1997 | Lampela et al. . |
| 5,676,225 | 10/1997 | Miyata . |
| 5,678,407 | 10/1997 | Hara . |

FOREIGN PATENT DOCUMENTS

| | | | |
|---|---|---|---|
| WO 94015081 | 7/1994 | WIPO | 123/559.1 |

*Primary Examiner*—Noah P. Kamen

*Attorney, Agent, or Firm*—Gerald E. Helget; Rider, Bennett, Egan & Arundel

[57] ABSTRACT

A supercharger for a motor vehicle internal combustion engine, the engine having an air intake, a crankshaft, a rotating engine accessory and shaft, the supercharger being driven by the rotating engine accessory shaft, the supercharger consisting of a rotating turbine which receives atmospheric air and provides compressed air to the engine's air intake. The rotating turbine is connected to the rotating engine accessory shaft for rotational movement. In a preferred implementation, the rotating engine accessory is the alternator. A number of gears between the alternator shaft and the turbine increases the speed of the turbine relative to the alternator shaft. The apparatus may include a two-speed clutch mounted on the engine's crankshaft to provide two speeds for the alternator shaft.

17 Claims, 4 Drawing Sheets

10
36
70
24
74
34
38
72
82
76
14
82
82
78
80

TWO-SPEED SUPERCHARGER

BACKGROUND OF THE INVENTION

Many techniques have been devised to increase the performance of automotive internal combustion engines. Supercharger systems have been developed that substantially boost engine performance. These systems operate to increase air pressure delivered to the intake manifold of the engine before being mixed with the fuel. The increased air pressure enhances the combustibility of the fuel, thus making it more powerful. This added power then increases engine power and torque at both lower and higher rpms than would otherwise be possible. Superchargers are simple and cheap, unlike superchargers that do not suffer from a response lag time because they are generally mechanically driven. Superchargers are more complicated and can be very expensive, although they do solve the problem of incomplete combustion when an engine is initially leaving idle speeds. Acceleration is also greatly improved with a typical mechanically driven supercharger.

However, the complicated belts and pulleys used in mechanical superchargers require for operation as much as 40% of the engine's power output, which exacts a price of shortening the engine's life span for the increased performance.

Superchargers on the other hand, are passive performance boosting devices that are driven by the exhaust from the engine. The passive design of the supercharger does not adversely affect the life span of the engine to the degree that a supercharger does.

Superchargers suffer a lag in response time because they are driven by exhaust gases and these gases are under very little pressure and velocity when the engine is at idle. The supercharger has very little rotational velocity to supply the engine with all the fresh air that is needed to complete combustion of all the fuel that is being forced into a vehicles combustion chamber. Hence large Semi's, ships, tractors, trucks, power plants and transit buses can be seen emitting black smoke as the diesel fuel is not completely burned initially on some heavy vehicles.

The superchargers have not gotten over their initial lag before they offer a power boost to the engine.

Even cars are being equipped more frequently with turbo chargers as engine size and weight must be kept to a minimum but the driving public wants more power from these smaller engines. These automobiles will suffer from the same incomplete combustion as larger vehicles although it will be less obvious from a visual point of view and surely less time in duration, but incomplete combustion none the less.

To overcome this some areas of the country are requiring oxygenated fuels, and low-sulfur diesel, be burnt in all of their vehicles especially during certain times of the year. Auto manufacturers are also to begin producing 85 compliant motors for vehicles. In essence, these vehicles can burn a mixture of 85 per cent ethanol and 15 per cent gasoline. This extra oxygen improves the initial lack of oxygen some vehicles suffer from on acceleration from low speeds or stopped conditions thereby reducing pollutants and smog contributing effects. If these engines were to be adjusted lean enough (oxygen rich-fuel stingy), for all operating conditions they would overheat during highway conditions on warm days. They can be adjusted and controlled to burn completely at cruising speeds but that leaves an oxygen-deprived state at idle.

Smaller engines in personal vehicles would be possible and acceptable to the consuming public if there were a way to supercharger these vehicles without the hassle that comes with present superchargers. This hassle is the warm-up period before a car is driven at highway speeds and a cooling-off period before the engine is shut off.

Presently, catalytic converters aid in the low emissions scenario of most gasoline powered engines, but these only work after they have become hot, and are little or no help to a cleaner burning engine when the engine is first started up, and before it is warmed up.

Another problem with ordinary superchargers is that heat of the exhaust gases which drive the supercharger is transferred to the center bearing that provides support for the supercharger's turbine. Present designs typically have an oil supply and engine coolant supply going to the supercharger bearing. This is to maintain lubrication and cooling to this critical bearing while the engine is running. This design is adequate as long as the engine is operating. However, when the engine is shut off the oil and coolant stop flowing immediately and if the bearing is supporting a hot turbine that has just been revolving at 40,000 rpm's or more the bearing literally begins to cook.

Most recommendations are for allowing the motor to idle 3 minutes before shutting off the engine. This allows this bearing to cool off before removing critical oil and cooling from the bearing. Repeated occurrences of shutting off the engine before allowing an adequate cooling-off time for the supercharger bearing leads to premature bearing failure and expensive repairs.

Several solutions have been developed to overcome the problem of turbo lag. One solution combines a supercharger with a supercharger. The supercharger drives the supercharger until the engine has reached a threshold level at which point it takes over the supercharger's job. This has the advantage of limiting the use of the supercharger, but it also has the drawback of being an active system that shortens engine life, as well as being overly complex.

By driving a simple supercharger by a belt, and keeping it simple and inexpensive, the best of both can be achieved. By removing the turbine from exhaust gas stream, the excess heating to the turbine bearing is minimized and the compressed air itself is the only factor for heating. However, this heat transfers minimally to the bearing. The bearing is thus able to better withstand possible abuse by the average driver who doesn't want to be bothered by details, such as letting the engine run for several minutes after they reach their destination.

SUMMARY OF THE INVENTION

A supercharger for a motor vehicle internal combustion engine, the engine having an air intake, a crankshaft, a rotating engine accessory and shaft, the supercharger being driven by the rotating engine accessory shaft, the supercharger consisting of a rotating turbine which receives atmospheric air and provides compressed air to the engine's air intake. The rotating turbine is connected to the rotating engine accessory shaft for rotational movement. In a preferred implementation, the rotating engine accessory is the alternator. A number of gears between the alternator shaft and the turbine increases the speed of the turbine relative to the alternator shaft. The apparatus may include a two-speed clutch mounted on the engine's crankshaft to provide two speeds for the alternator shaft.

A principal object and advantage of the present invention is that the gear ratio may be increased from the rear of the alternator to the input shaft of the supercharger and the response lag time is all but eliminated. This will accomplish the improvement in low speed supercharger response time and engine acceleration.

A second principal object and advantage of the present invention is adding a two speed drive to the engine's alternator, or all of the belt driven accessories for that matter. The speed of the supercharger may be slowed down when the engine reaches and exceeds cruising speeds, thus preventing over boosting of the system.

Another principal object and advantage of the present invention is that by removing the supercharger drive from the heated exhaust gases to the rear of an alternator, no heat is transferred from those hot gases, thus lowering the heat of the compressed gases and the center bearing that provides support of the turbine. This will make inter-cooling less critical and more effective, requiring less power to compress the fresh air. It will also help prolong the life of the center support bearing as well.

Another principal object and advantage of the present invention is that it can improve fuel mileage and create a cleaner burning engine, thus reducing air pollution, saving scarce resources, and having a positive impact on the environment.

Another principal object and advantage of the present invention is that it does not require a separate compressor fan, since the supercharger turbine is being driven by a belt instead of by exhaust gases and can therefore act as the compressor fan.

DETAILED DESCRIPTION OF THE PREFERRED EMBODIMENTS

Figure 1:
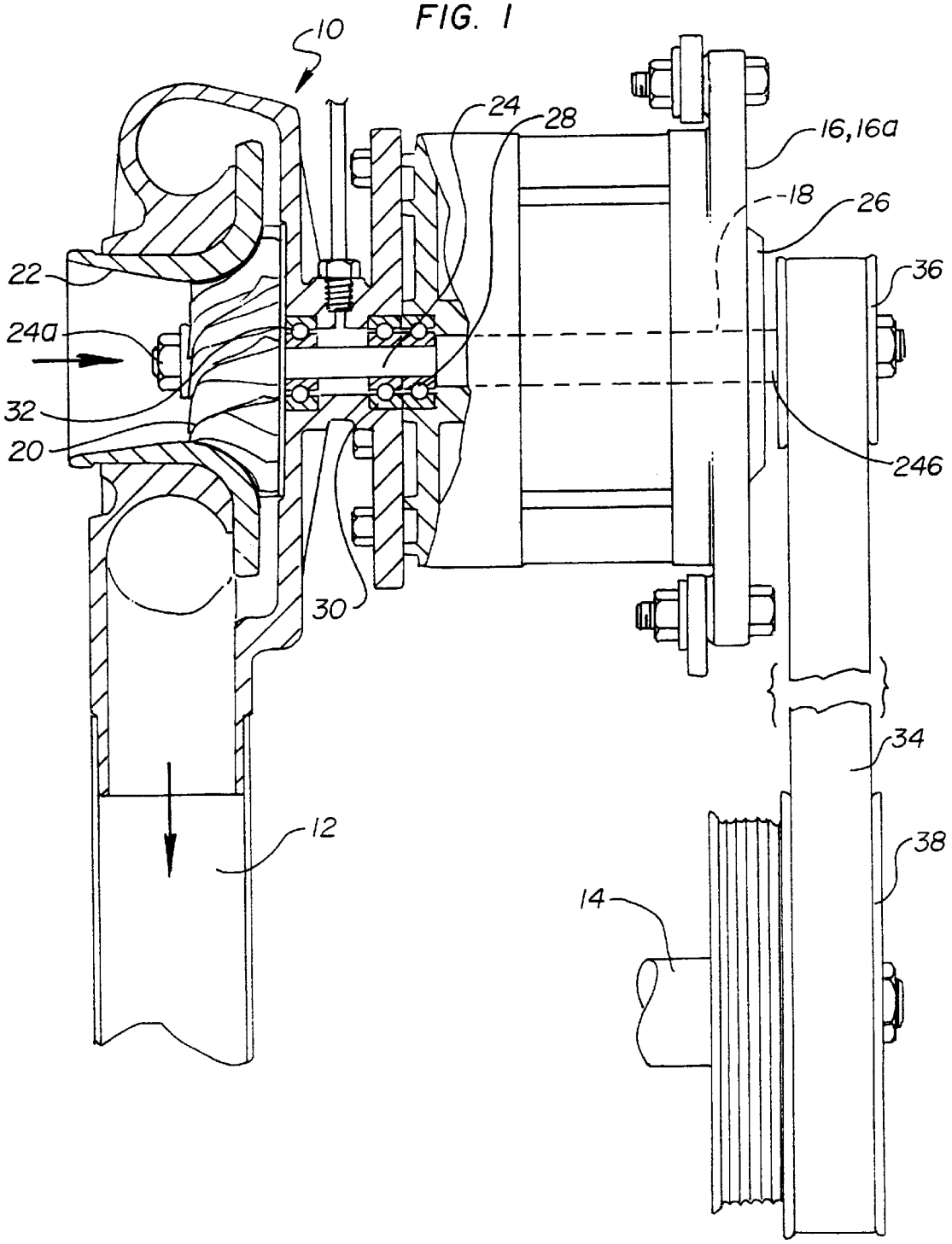
FIG. 1 is a schematic of a first embodiment of the supercharger of the present invention mounted on a vehicle's rotating engine accessory.

The supercharger of the present invention is generally designated in the Figures as reference numeral 10.

The supercharger 10 operates with an internal combustion engine (not shown). The engine has an air intake 12, a crankshaft 14, a rotating engine accessory 16, and an accessory shaft 18 on which the accessory 16 rotates. In the preferred embodiment, the accessory 16 is an alternator 16*a*. However, any other rotating accessory such as an air conditioner, fan belt, generator, etc. may be used.

The supercharger 10 comprises a rotating turbine 20. The turbine 20 receives atmospheric air from an intake 22 and compresses the air by rotary motion, delivering compressed air to the engine's air intake 12.

The turbine 20 is connected to the accessory 16 for rotational movement as will be described below.

In a first embodiment, the supercharger further comprises a shaft 24 engaging the turbine 20 for rotational movement of the turbine 20 about the shaft 24. The shaft 24 has a first end 24*a* and a second end 24*b*, and the turbine 20 is connected to the first end 24*a*. The shaft 24, in the first embodiment, is preferably of integral one-piece construction with the accessory's shaft 18, so that the shaft 24 rotates synchronously with the accessory's shaft 18. However, the shaft 24 could also be an extension (not shown) connected to the accessory's shaft 18 by any means such as screws, bolts, pins, keyways, etc. that allows the shaft 24 to rotate synchronously with the accessory's shaft 18.

The accessory's shaft 18 rotates, as is known in the art, on bearings 26 and 28. Additional bearings 30, 32 are provided to support the shaft 24.

As is known in the art, the accessory 16 is preferably connected to the crankshaft 14 by belt 34 and first pulley 36 and second pulley 38. In the first embodiment, the accessory shaft 18 and shaft 24 thus rotate at a constant ratio in proportionate to the rotation and speed of the crankshaft 14. The rotational speed of the crankshaft is not enhanced.

In a second embodiment (FIG. 2), the shaft 24 is separate from the accessory's shaft 18 and the supercharger 10 further comprises a plurality of gears 40 connecting the shaft 24 to the accessory's shaft 18. The gear ratios of the gears 40 are designed so that the gears 40 increase the rotational speed of the turbine 20 relative to the rotational speed of the accessory's shaft 18.

Figure 2:
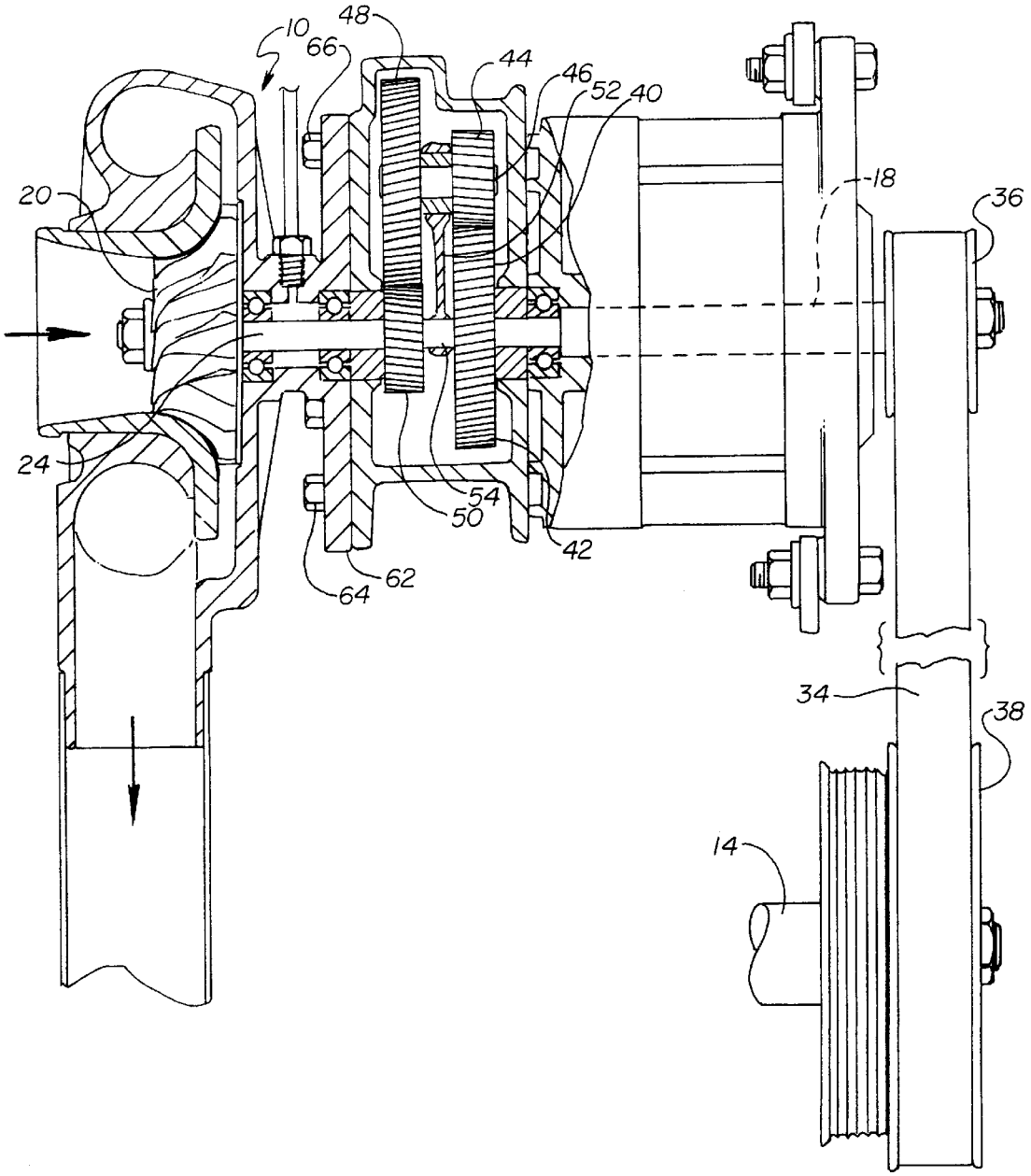
FIG. 2 is a schematic of a second embodiment of the supercharger of the present invention mounted on a vehicle's rotating engine accessory.

As shown in FIG. 2, the accessory's shaft 18 drives first gear 42, which in turn drives second gear 44 on shaft 46. Because the diameter of first gear 42 is greater than the diameter of second gear 44, second gear 44 will rotate at a speed greater than that of first gear 42.

If additional rotational speed enhancement is required, shaft 46 may cause third gear 48 to rotate, which in turn meshes with gear 50 on the shaft 24.

The end of the accessory's shaft 18 and the beginning of shaft 24 may preferably be both supported by a connecting rod 52 which contains a bearing 54 thus allowing shafts 24 and 18 to rotate at different speeds.

The entire gear housing 62 may preferably be bolted to the rear of the accessory 16 through bolts 64 and 66 thus allowing the entire two-piece unit to operate as one with a different gearing ratio between the two.

Figure 3:
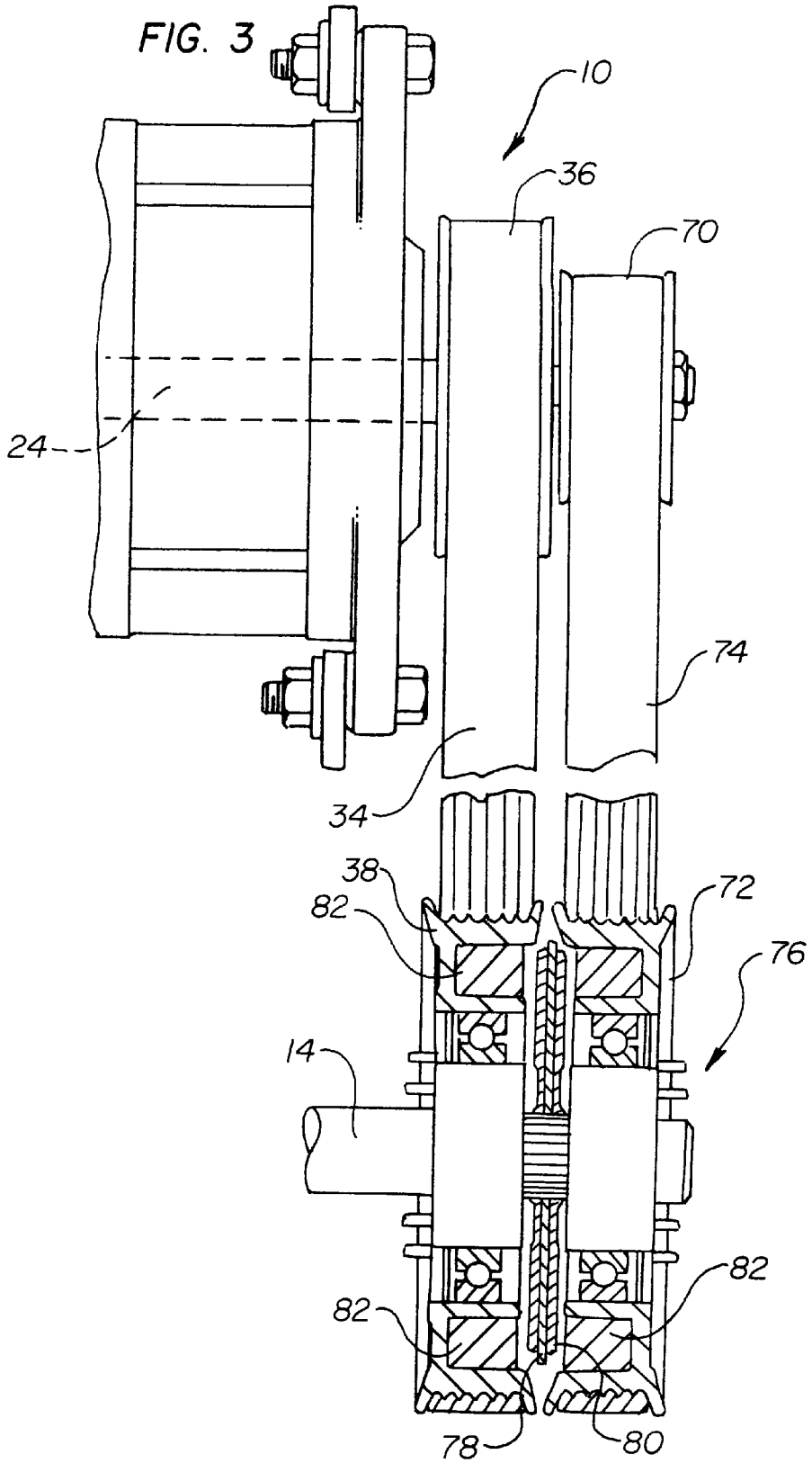
FIG. 3 is a schematic of a third embodiment of the supercharger of the present invention mounted on a vehicle's rotating engine accessory.

In a third embodiment (FIG. 3), the supercharger 10 further comprises a third pulley 70 attached to the shaft 24, a fourth pulley 72 attached to the crankshaft 14, a second belt 74 connecting the third pulley 70 to the fourth pulley 72, and a clutch 76 for alternately engaging the second pulley 38 and fourth pulley 72 for synchronous rotating engagement with the crankshaft 14.

The clutch may be any clutch known in the art, but is preferably electromagnetic. A novel electromagnetic clutch for such an application is described in a co-pending United States Patent Application entitled BELT TRANSMISSION AND CLUTCH FOR VEHICLE ACCESSORIES, which is hereby incorporated by reference.

In its simplest form, the clutch 76 may comprise a clutch support plate 78 mounted to the crankshaft 14 with key ways, snap rings, etc. to prevent lateral as well as rotational movement with respect to the crankshaft 14. A pair of clutch plates 80 are separated from the clutch support plate 78 by leaf springs (not shown), with one end of each leaf spring attached to the clutch support plate and the other end attached to one of the clutch plates.

Electromagnets 82 are energized to attract one of the clutch plates 80 to either of the pulleys 38, 72, thus imparting the rotational movement of the crankshaft 14 to one of the pulleys 38, 72.

Because two belts are used to connect the pulleys 38, 72 to the pulleys 36,70, there is an opportunity to drive the shaft 24 at two different speeds. In the first example (FIG. 3), the diameters of the second pulley 38 and fourth pulley 72 are the same. However, the diameters of the first pulley 36 and third pulley 70 are different. The belts 34, 74 will thus drive the shaft 24 at different speeds. In a second example (FIG. 4), the diameters of the first pulley 36 and third pulley 70 are the same, but the diameters of the second pulley 38 and fourth pulley 72 are different.

Figure 4:
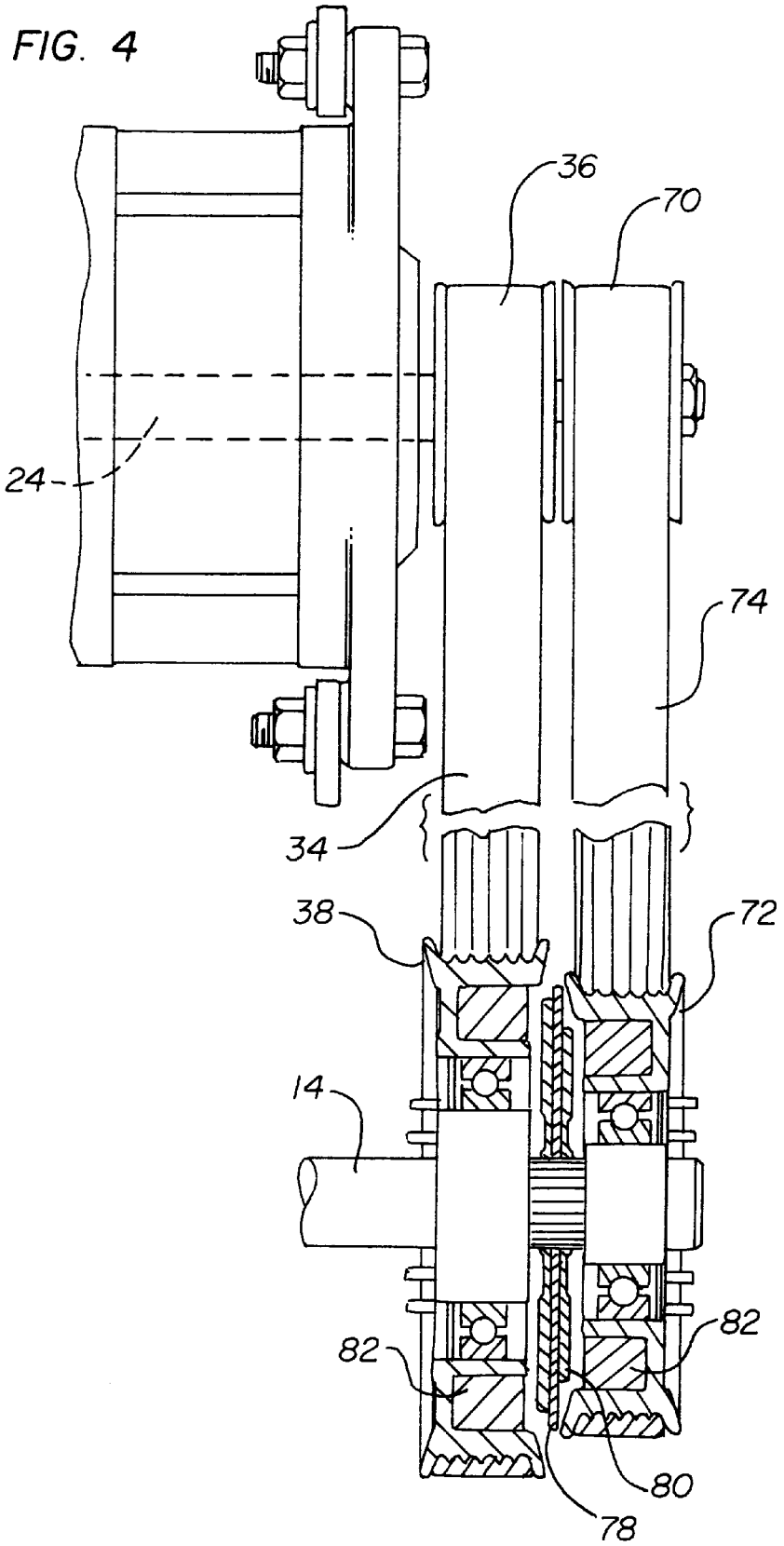
FIG. 4 is a schematic of a fourth embodiment of the supercharger of the present invention mounted on a vehicle's rotating engine accessory.

FIG. 4 also shows that differential speed selection with the clutch may be combined with speed enhancement by the plurality of gears 40, as described previously.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A supercharger for an internal combustion engine, the engine having an air intake, a crankshaft, an accessory and an accessory shaft on which the accessory rotates, said supercharger being driven by said accessory shaft, said supercharger comprising a rotating turbine, said rotating turbine receiving atmospheric air and said rotating turbine providing compressed air to the engine's air intake, said rotating turbine being connected to said accessory shaft for rotational movement, wherein said shaft is separate from the accessory shaft and further comprises a plurality of gears connecting the shaft to the accessory shaft and said gears increase the rotational speed of the turbine relative to the rotational speed of the accessory shaft.

2. The supercharger of claim 1, wherein said accessory further comprises an alternator and said accessory shaft further comprises an alternator shaft.

3. The supercharger of claim 1, wherein said supercharger further comprises a shaft engaging said turbine.

4. The supercharger of claim 1, wherein said shaft is of integral one-piece construction with the accessory shaft.

5. The supercharger of claim 1, further comprising a multi-speed clutch mounted on the engine's crankshaft, the crankshaft being connected to the accessory shaft through alternate connections and the crankshaft providing rotational movement to the accessory shaft, said clutch providing more than one degree of rotational speed of the accessory shaft relative to the crankshaft.

6. The supercharger of claim 5, wherein said clutch is electromagnetic.

7. A supercharger for an internal combustion engine, the supercharger being driven from the crankshaft of the engine, said supercharger comprising:

(a) a rotating turbine, said rotating turbine receiving atmospheric air and said rotating turbine providing compressed air to the engine's air intake, (b) a shaft engaging said rotating turbine, said shaft having a first end and a second end, said rotating turbine being attached to said first end, said shaft being mounted to the vehicle's engine by bearings, (c) a rotating engine accessory shaft driven by the crankshaft, said second end of said shaft being connected to said rotating engine accessory shaft, (d) a first pulley attached to said rotating engine accessory shaft, (e) a second pulley attached to the vehicle's crankshaft, and (f) a belt connecting said first pulley to said second pulley whereby rotation of the vehicle's crankshaft causes rotation of said rotating turbine through said second pulley, said belt, said first pulley, said rotating engine accessory shaft, and said shaft, (g) wherein said shaft is separate from the accessory shaft and further comprises a plurality of gears connecting the shaft to the accessory shaft and said gears increase the rotational speed of the turbine relative to the rotational speed of the accessory shaft.

8. The supercharger of claim 7, wherein said rotating engine accessory shaft further comprises an alternator shaft.

9. The supercharger of claim 8, further comprising a plurality of gears connecting the rotating engine accessory shaft to the shaft to increase the rotational speed of the turbine relative to the rotational speed of the rotating engine accessory shaft.

10. The supercharger of claim 7, further comprising a third pulley attached to said rotating engine accessory shaft, a fourth pulley attached to the vehicle's crankshaft, a second belt connecting said third pulley to said fourth pulley, and a clutch for alternately engaging said second pulley and said fourth pulley for synchronous rotating engagement with the vehicle's crankshaft.

11. The supercharger of claim 10, wherein the diameter of said first pulley is the same as the diameter of said third pulley and wherein the diameter of said second pulley is different from the diameter of said fourth pulley, thereby providing two rotational speeds to the shaft and turbine.

12. The supercharger of claim 10, wherein the diameter of said second pulley is the same as the diameter of said fourth pulley and wherein the diameter of said first pulley is different from the diameter of said third pulley, thereby providing two rotational speeds to the shaft and turbine.

13. A supercharger for an internal combustion engine, the supercharger being driven from the crankshaft of the engine, said supercharger comprising:

(a) a rotating turbine, said rotating turbine receiving atmospheric air and said rotating turbine providing compressed air to the engine's air intake, (b) a shaft engaging said rotating turbine, said shaft having a first end and a second end, said rotating turbine being attached to said first end, said shaft being mounted to the vehicle's engine by bearings, (c) a rotating engine accessory shaft driven by the crankshaft, said second end of said shaft being connected to said rotating engine accessory shaft, (d) a first pulley attached to said rotating engine accessory shaft, (e) a second pulley attached to the vehicle's crankshaft, (f) a belt connecting said first pulley to said second pulley whereby rotation of the vehicle's crankshaft causes rotation of said rotating turbine through said second pulley, said belt, said first pulley, said rotating engine accessory shaft, and said shaft, and (g) third pulley attached to the rotating engine accessory shaft, a fourth pulley attached to the vehicle's crankshaft, a second belt connecting said third pulley to said fourth pulley, and a clutch for alternately engaging said second pulley and said fourth pulley for synchronous rotating engagement with the vehicle's crankshaft.

14. The supercharger of claim 13, wherein the diameter of said first pulley is the same as the diameter of said third pulley and wherein the diameter of said second pulley is different from the diameter of said fourth pulley, thereby providing two rotational speeds to the shaft and turbine.

15. The supercharger of claim 13, wherein the diameter of said second pulley is the same as the diameter of said fourth pulley and wherein the diameter of said first pulley is different from the diameter of said third pulley, thereby providing two rotational speeds to the shaft and turbine.

16. The supercharger of claim 13, further comprising a plurality of gears connecting the shaft to the rotating engine accessory shaft to increase the rotational speed of the turbine relative to the rotational speed of the rotating engine accessory shaft.

17. The supercharger of claim 13, wherein said clutch is electromagnetic.

* * * * *

UNITED STATES PATENT AND TRADEMARK OFFICE

CERTIFICATE OF CORRECTION

PATENT NO. : 6,082,340
DATED : July 4, 2000
INVENTOR(S) : Charles L. Heimark

It is certified that error appears in the above-identified patent and that said Letters Patent is hereby corrected as shown below:

Title page,
Item [57] ABSTRACT, line 1, please delete "supercharger" and replace with
-- turbocharger --

Column 6,
Lines 44-67, claims 9 through 12 should read as follows:

9. The supercharger of claim 7, further comprising a third pulley attached to said rotating engine accessory shaft, a fourth pulley attached to the vehicle's crankshaft, a second belt connecting said third pulley to said fourth pulley, and a clutch for alternately engaging said second pulley and said fourth pulley for synchronous rotating engagement with the vehicle's crankshaft.

10. The supercharger of claim 9, wherein the diameter of said first pulley is the same as the diameter of said third pulley and wherein the diameter of said second pulley is different from the diameter of said fourth pulley, thereby providing two rotational speeds to the shaft and turbine.

11. The supercharger of claim 9, wherein the diameter of said second pulley is the same as the diameter of said fourth pulley and wherein the diameter of said first pulley is different from the diameter of said third pulley, thereby providing two rotational speeds to the shaft and turbine.

12. The supercharger of claim 8, further comprising a plurality of gears connecting the rotating engine accessory shaft to the shaft to increase the rotational speed of the turbine relative to the rotational speed of the rotating engine accessory shaft.

Signed and Sealed this

Twenty-eighth Day of May, 2002

*Attest:*

*Attesting Officer*

JAMES E. ROGAN
*Director of the United States Patent and Trademark Office*